US005907881A

United States Patent [19]

Safdie

[11] Patent Number: 5,907,881

[45] Date of Patent: Jun. 1, 1999

[54] PROTECTIVE COVERING FOR A SHOE OUTERSOLE

[76] Inventor: Edward M. Safdie, 245 Carter Dr., Edison, N.J. 08817

[21] Appl. No.: 09/106,373

[22] Filed: Jun. 29, 1998

Related U.S. Application Data

[62] Division of application No. 08/653,124, May 24, 1996, Pat. No. 5,771,605, and a continuation of application No. 08/362,907, Dec. 23, 1994, abandoned.

[51] Int. Cl.[6] ..... A43D 9/00; A43D 11/00

[52] U.S. Cl. ..... 12/142 R; 12/142 RS

[58] Field of Search ..... 36/15, 100, 73, 36/97, 8.4, 71.5, 22 R, 103, 132, 136, 25 R, 30 R, 72 R, 7.5; 12/142 K, 142 T, 142 R, 142 RS

[56] References Cited

U.S. PATENT DOCUMENTS

| | | | |
|---|---|---|---|
| 2,126,608 | 8/1938 | Brady | 36/8.4 |
| 2,134,196 | 10/1938 | Miller | 36/8.4 |
| 2,408,152 | 9/1946 | Porcelli | 36/62 |
| 2,603,899 | 7/1952 | Leander | 206/813 |
| 2,985,920 | 5/1961 | McCarthy | 36/25 R X |
| 3,693,269 | 9/1972 | Guarrera | 36/15 |
| 3,903,620 | 9/1975 | Gillet | 36/15 |
| 4,279,083 | 7/1981 | Dug | 36/101 |
| 5,433,695 | 7/1995 | Drennan | 36/15 X |
| 5,771,605 | 6/1998 | Safdie | 36/25 R |

*Primary Examiner*—B. Dayoan
*Attorney, Agent, or Firm*—Ezra Sutton

[57] ABSTRACT

A method of manufacturing a shoe having an outersole with a removable protective covering, including the steps of applying a sheet of protective covering to a sheet of outersole material with adhesive to form a composite sheet; applying printed indicia on the protective covering at predetermined locations; stamping out the composite sheet to form a plurality of outersoles, each having the protective covering and the printed indicia to form finished outersoles; and attaching each of the finished outersoles to a shoe upper to form a shoe so that the protective covering is removable.

9 Claims, 3 Drawing Sheets

PROTECTIVE COVERING FOR A SHOE OUTERSOLE

This application is a division of application number 08/653,124 filed May 24, 1996, now U.S. Pat. No. 5,771, 605, and a continuation of U.S. Ser. No. 08/362,907, filed Dec. 23, 1994, abandoned.

FIELD OF THE INVENTION

The invention relates to an article and method of manufacturing a protective covering for a shoe outersole that can also be printed on with advertising; product information; footwear care information and the like.

BACKGROUND OF THE INVENTION

At present, protective coverings for the inner and/or outersoles of footwear have been attached to their respective inner and outersoles after the footwear had been manufactured at the factory, or they have been attached at the point of sale in the retail store. This procedure is labor intensive and costly for the manufacturer or retailer.

Since the protective covering is not applied until after the footwear is manufactured, the outersole is not protected during various chemical treatment steps, such as the applying of dye, water repellent, or conditioners to the shoe upper. Also, the protective covering does not provide for printed matter or advertising on the covering surface.

DESCRIPTION OF THE PRIOR ART

Protective shoe cover liners for the inner and outersoles of footwear have been disclosed in the prior art. For example, U.S. Pat. No. 2,134,196 discloses a protective cover for shoe soles and heels. The covers comprise a flexible backing made from paper, plastic film, and the like having an adhesive-coated surface which adheres to the leather sole and heel. This protective cover prevents the shoe bottoms from becoming soiled and shopworn when customers repeatedly try on the shoes being sold at the retail stores. The protective cover for the sole has a tab for removing the cover when purchased. It is apparent from this patent that the protective covers are attached after the shoes have been manufactured.

U.S. Pat. No. 2,134,220 discloses protective covers for insoles of shoes used in the manufacture of shoes that have cement applied to them. The cover is made of paper, cellophane, plastic, and the like and is secured to the insole by an adhesive-coated surface of the body portion. The cover is provided with integral tabs, which are adhesive free. When the shoe is completed in the manufacturing process, the tab is pulled, removing the cover from the insole of the shoe. The primary purpose of for the cover is to protect the insole of the shoe from getting cement on it or soiled during the manufacturing process.

None of the aforementioned patents disclose the method of construction of the present invention.

Accordingly, it is an object of the present invention to provide a method of manufacturing footwear having a protective outersole covering as an integral part of the shoe.

Another object of the present invention is to provide a protective outersole covering during manufacture of the shoe but before chemical treatment of the shoe so as to protect the outersole from the stains of dyes, water repellents, or conditioning products that may be applied to the shoe uppers during or after manufacturing.

Another object of the present invention is to provide a protective outersole covering which protects the entire outersole from the toe to the rear end of the outersole.

Another object of the present invention is to provide a protective outersole covering at the point of sale which prevents the shoe outersole from becoming soiled, scuffed, and/or shopworn at the retail store as a result of customers handling and trying on the shoes.

A further object of the present invention is to provide a protective outersole covering that is mass produced and is placed on the outersole during the manufacturing operation in an automated and economical manner.

A still further object of the present invention is to provide a protective outersole covering having printed matter contained thereon in the form of advertising, or product features, or shoe handling and care, or the like.

Another object of the present invention is to provide a protective outersole covering that is adapted to receive a preprinted label in the form of advertising and the like.

SUMMARY OF THE INVENTION

The present invention provides for a method of manufacturing footwear having an outersole with a removable protective covering. These manufacturing procedures comprise the following steps:

1) The applying of a sheet of protective covering to a sheet of outersole material with an adhesive backing to form a composite sheet;

2) The printing of advertisements, or product features, or footwear care and handling steps on the protective covering film sheet at predetermined locations;

3) The stamping out of the composite sheet to form a plurality of outersoles, each having a protective covering with printed matter contained thereon to form a finished outersole; and 4) The attachment of the finished outersole to a shoe upper to form a shoe, so that the protective covering is removable.

The protective covering prevents chemicals from getting on the outersole during and after manufacturing; prevents scuffing of the outersole at the point of sale; allows for advertising at the point of sale; and prevents dyes from coloring the outersole when custom dyeing a dyeable shoe.

BRIEF DESCRIPTION OF THE DRAWINGS

Further objects, features, and advantages of the present invention will become apparent upon consideration of the detailed description of the presently-preferred embodiments, when taken in conjunction with the accompanying drawings, wherein.

DETAILED DESCRIPTION OF THE PREFERRED EMBODIMENT

Figure 1:
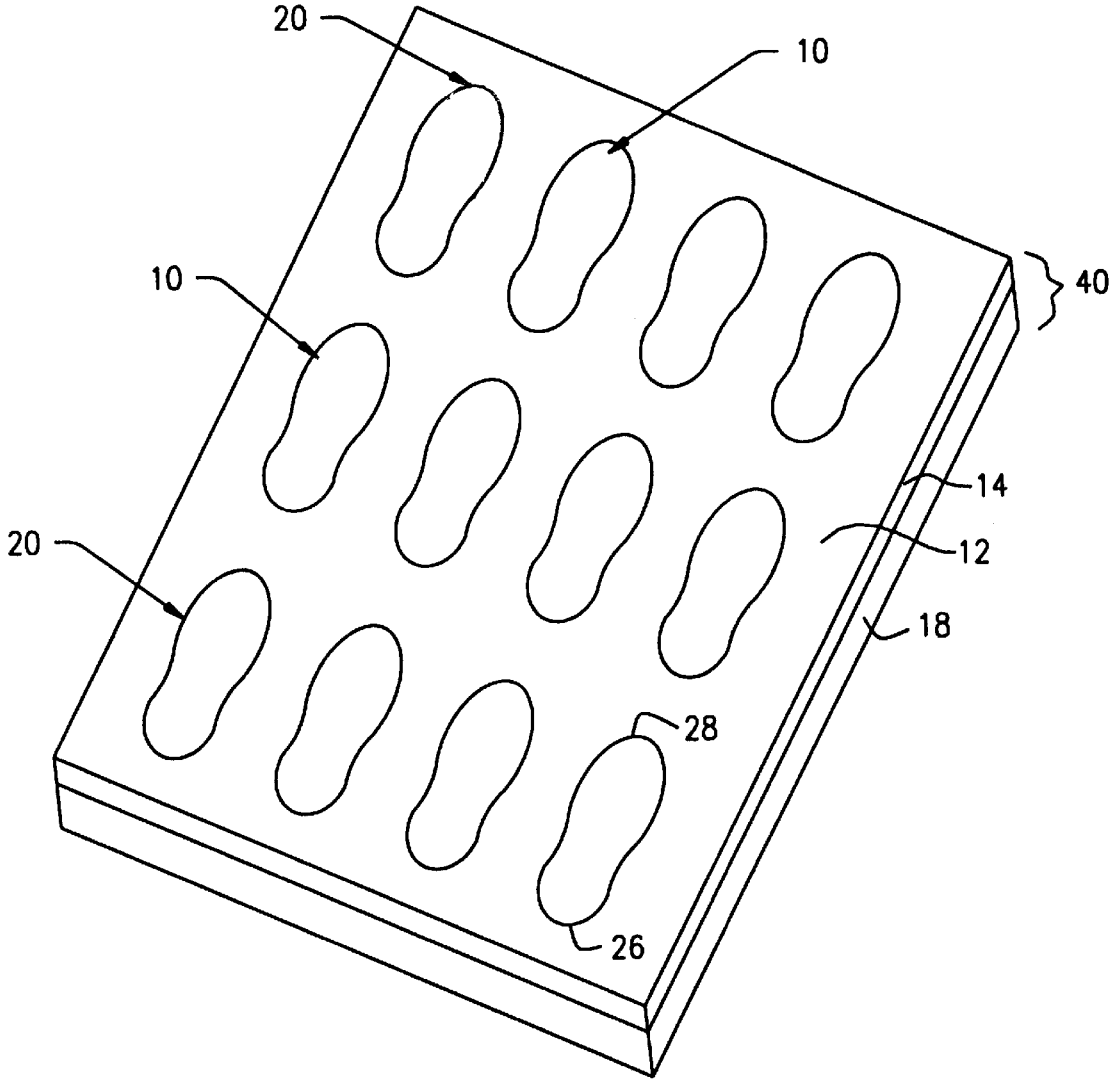
FIG. 1 is a perspective view of the integral composite sheet of the present invention showing the protective covering laminated and adhered to the outersole material and stamped out to form a plurality of outersoles.

The preferred embodiment of the present invention provides for a method of manufacturing a shoe 30 having an outersole 20 with a removable protective covering 10, which are represented in FIGS. 1 through 4. The protective covering 10 for the outersole 20 includes a protective covering material 12 having on one side an adhesive backing 14 and on the outer side printed indicia 16, if desired. The covering material 12 is a thin sheet film made of paper, cellophane, polyvinylchloride (PVC), aluminum foil, polyethylene (PE), TEFLON, miscellaneous plastic films, or other composite materials used in manufacturing outersoles. The adhesive backing 14 may be made from pressure-sensitive adhesives or glues that are readily removed with the protective covering 10 when it is peeled away from the outersole 20. The outersole 20 may be made of vinyl material, rubber, leather, miscellaneous plastic materials, or any other material normally used in manufacturing outersoles and may be attached to a shoe upper by gluing, stitching 32, or stapling.

Alternatively, the covering material 12 may be a synthetic rubber or latex or similar material that is applied to the outersole 20 by spraying, brushing, or rolling it on. This material is a liquid with adhesive in it, and it will dry and cure itself and become a removable sheet that may be peeled off.

Figure 2:
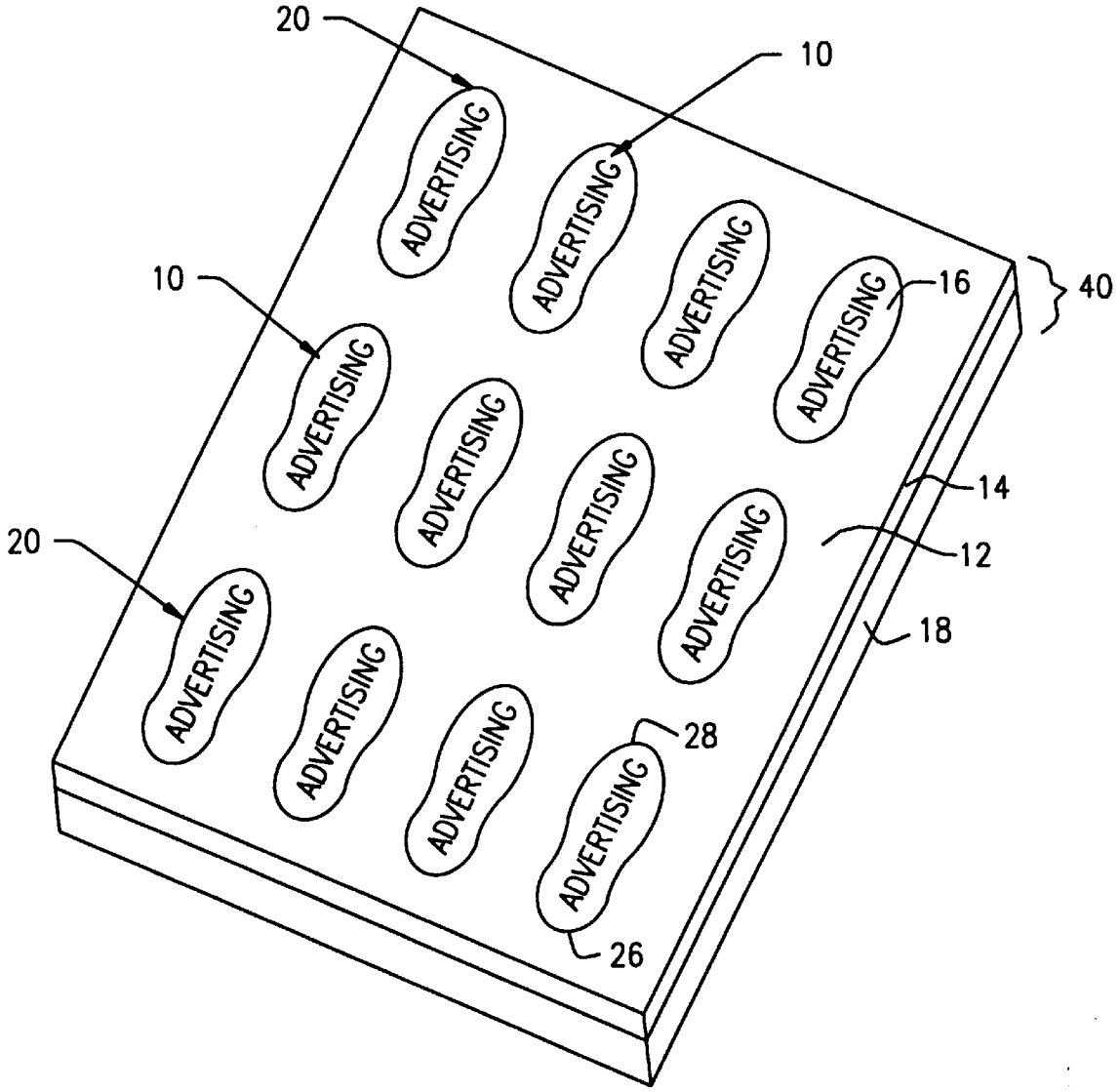
FIG. 2 is a perspective view of the outersoles having advertising indicia contained thereon.

The method of manufacturing the protective coverings 10 for outersoles 20 of shoes 30 comprises a few steps. The initial step for this manufacturing procedure, as depicted in FIGS. 1 and 2, is the applying of a thin film sheet 12 (of protective covering 10) having an adhesive backing 14 to a sheet of outersole material 18 to form the composite sheet 40. There can be printed indicia on the film sheet 12 at specific locations within the sheet 12 which are preprinted prior to laminating the sheet 12 to outersole sheet 18. The printed indicia 16 can be advertising, or product information, handling and care of product, if desired. Alternatively, a preprinted label 50 may be adhered to film sheet 12, as shown in FIG. 4.

The next step is the stamping out of the composite sheet 40 to form a plurality of outersoles 20, each having the protective covering 10 and printed indicia 16 thereon which forms the finished outersoles 20, as depicted by FIGS. 1 and 2 of the drawings.

Figure 3:
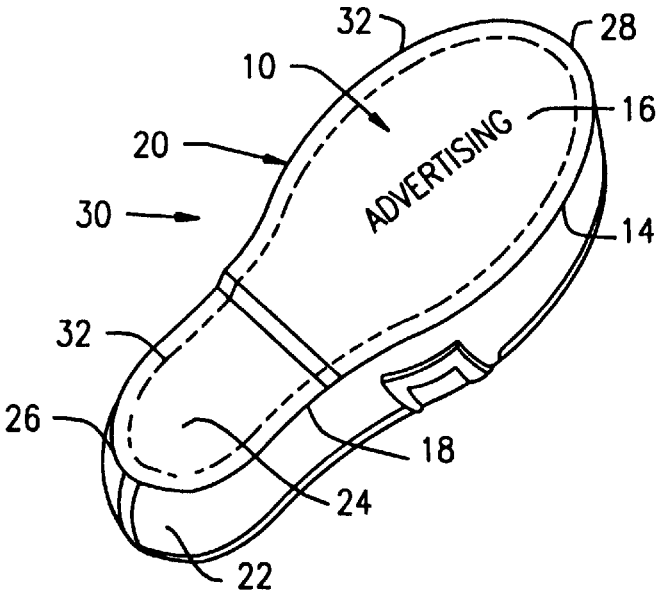
FIG. 3 is a perspective view of the bottom of a men's loafer shoe showing the outersole sewn to the shoe upper having advertising indicia on the protective covering.
Figure 4:
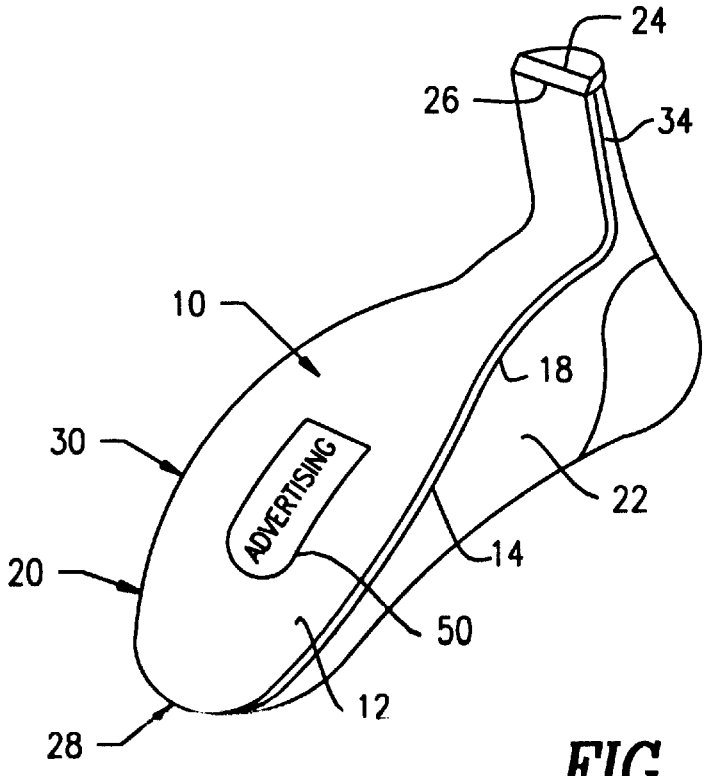
FIG. 4 is a perspective view of the bottom of a ladies' high heel shoe showing the outersole glued to a shoe upper having the protective covering attached to the outersole.

The final step is the attaching of the finished outersole 20 to a shoe upper 22 by sewn stitching 32, or gluing (not shown), or stapling (not shown) to form a shoe 30, as shown in FIGS. 3 and 4, so that the protective covering 10 is removable at the point of sale. As depicted in FIG. 3, the protective covering 10 of finished outersole 20 is attached to the shoe upper 20 by sewn stitching 32, such that the outersole 20 is protective from the rear end 26 to the toe end 28 of outersole 20. In this particular embodiment of loafer shoe 30, the protective covering 10 covers the heel area 24, as the heel area is an integral part of the outersole 20. As shown in this embodiment of FIG. 3, printed indicia 16 is located along the entire length of the outersole's 20 protective covering 10. Printed indicia 16 in other embodiments can be placed in the front section of the sole 20 only, if desired.

In another embodiment of a typical men's shoe (not shown), after the outersole 20 is attached to the shoe upper 22, a rubber heel is then attached to the outersole 20 in a subsequent step, such that the rubber heel covers the heel area 32 of the protective covering 10. The protective covering 10 would have a perforation line at the heel's instep mark, so that protective covering 10 can be easily removed from the sole area.

In a further embodiment, as shown in FIG. 4, is a typical women's pump heel shoe 30 depicting the outersole 20 having a protective covering 10 being attached to the shoe upper 22 from the rear end 26 to the toe end 28 of outersole 20, such that protective covering 10 ends at the heel point 24 of heel pump section 34.

In general, the protective covering 10 of outersole 20, in subsequent procedural and/or optional operational manufacturing steps, protects the entire outersole 20 from stains of chemical dyeing, conditioning oils, or water repellency fluids which are used to treat the upper shoe section 22 of shoe 30. It also protects the outersole 20 from scuffing or damage at the point of sale.

ADVANTAGES OF THE PRESENT INVENTION

Accordingly, the primary advantage of the present invention is that it provides an article and method of manufacturing footwear having a protective outersole covering as an integral part of the shoe.

Another advantage of the present invention is that it provides a protective outersole covering before chemical treatment, which protects the outersole from the stains of dyes, water repellents, or conditioning oils that may be applied to the shoe uppers.

Another advantage of the present invention is that it provides a protective outersole covering which protects the entire outersole from the toe to the rear end of the outersole.

Another advantage of the present invention is that it provides a protective outersole covering at the point of sale which prevents the shoe outersole from becoming soiled, scuffed, and/or shopworn at the retail store.

A further advantage of the present invention is that it provides a protective outersole covering that is mass produced and is placed on the outersole during the manufacturing operations in an automated and economical manner.

A still further advantage of the present invention is that it provides a protective outersole covering having printed indicia material contained thereon in the form of advertising, product footwear features, shoe handling and care, or the like.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method of manufacturing a shoe having an outersole with a removable protective covering, comprising the steps of:

a) applying a sheet of protective covering to a sheet of outersole material with adhesive to form a composite sheet;

b) applying printed indicia on said protective covering at predetermined locations;

c) stamping out said composite sheet to form a plurality of outersoles, each having said protective covering and said printed indicia to form finished outersoles; and d) attaching each of said finished outersoles to a shoe upper to form a shoe so that said protective covering is removable.

2. A method of manufacturing a shoe in accordance with claim 1, wherein said protective covering is made of, material selected from the group consisting of paper, cellophane, polyvinylchoride (PVC), aluminum foil, polyethylene (PE), TEFLON, plastic films, synthetic rubber, latex, and composites of the foregoing.

3. A method of manufacturing a shoe in accordance with claim 1, wherein said outersole material is selected from the group consisting of a vinyl substrate, rubber, leather, and a plastic substrate.

4. A method of manufacturing a shoe in accordance with claim 1, wherein said adhesive is made of a pressure-sensitive adhesive or a pressure-sensitive glue.

5. A method of manufacturing a shoe in accordance with claim 1, wherein said indicia is printed and includes at least one of product features, product information, and advertising.

6. A method of manufacturing a shoe in accordance with claim 1, wherein the step of attaching is performed by sewn stitching.

7. A method of manufacturing a shoe in accordance with claim 1, wherein the step of attaching is performed by gluing.

8. A method of manufacturing a shoe in accordance with claim 1, wherein the step of attaching is performed by stapling.

9. A method of manufacturing a shoe in accordance with claim 1, wherein said shoe is one a man's shoe, a woman's shoe, a child's shoe, and a baby's shoe.

* * * * *